United States Patent [19]

Scribner

[11] 4,329,897

[45] May 18, 1982

[54] CONTROL SYSTEM FOR PNEUMATIC PUNCH PRESS FEEDERS

[76] Inventor: Albert W. Scribner, 6 Country Club Rd., Darien, Conn. 06820

[21] Appl. No.: 20,174

[22] Filed: Mar. 13, 1979

[51] Int. Cl.[3] ..... B26D 5/20

[52] U.S. Cl. ..... 83/225; 83/227; 226/150; 226/162

[58] Field of Search ..... 83/277, 225; 226/115, 226/150, 162–166

[56] References Cited

U.S. PATENT DOCUMENTS

| | | | |
|---|---|---|---|
| 2,803,335 | 8/1957 | Powers | 226/166 |
| 3,038,645 | 6/1962 | Nordlof | 226/166 X |
| 4,140,261 | 2/1979 | Scribner | 226/151 X |

*Primary Examiner*—James M. Meister

[57] ABSTRACT

An improved semi-automatic control system for a punch press feeder, having a novel combination of three control components including a new main sequencing valve arrangement, a trigger valve and a reverser valve.

14 Claims, 7 Drawing Figures

CONTROL SYSTEM FOR PNEUMATIC PUNCH PRESS FEEDERS

BACKGROUND OF THE INVENTION

In the semi-automatic control system disclosed in my copending application Ser. No. 871,490 filed Jan. 23, 1978, now U.S. Pat. No. 4,175,688 and entitled Semi-Automatic Stock Feeder the main valve means for controlling the fluid motor means of the pneumatic feeders described therein are adapted to be controlled by a three-way trigger valve unit and a serially coupled cut-off valve unit. These two separate valve units may be advantageously simplified. It has been found that under some operating conditions the proper sequencing of actuation of stock gripping motors and feed slide motors is more difficult to achieve with feeders that have longer feed strokes such as twelve inches or more. Further it is desirable to have some sort of circuit safety means for preventing an inadvertent initiation of a feed-index cycle of movement of the feed slide due to occasional small random pressure leaks that may develop in the elements of the associated control circuit.

SUMMARY OF THE INVENTION

The present invention includes a novel combination of a main sequencing control valve circuit, a trigger valve and a reverse valve to form an improved semi-automatic control system for a pneumatic feeder. This system includes two main fluid actuated three way valves interconnected in cascade fashion so as to sequentially control the operation of the feed and stock gripping fluid motors; one of the main valves being adapted to be shifted to a first operative condition by operation of a trigger valve so as to thereby initiate a feed stroke of the feed slide, and being adapted to be shifted to a second operative condition by the operation of a reverse valve that is actuated in response to the completion of said feed stroke so as to thereby initiate an index stroke of said feed slide.

The principal object of the present invention is to provide an improved semi-automatic control system for a pneumatic punch press feeder wherein a novel combination of a special sequencing circuit, a trigger means and a reverse means is provided.

Other objects of the invention will become apparent as the disclosure progresses.

DETAILED DESCRIPTION OF THE INVENTION

Figure 1:
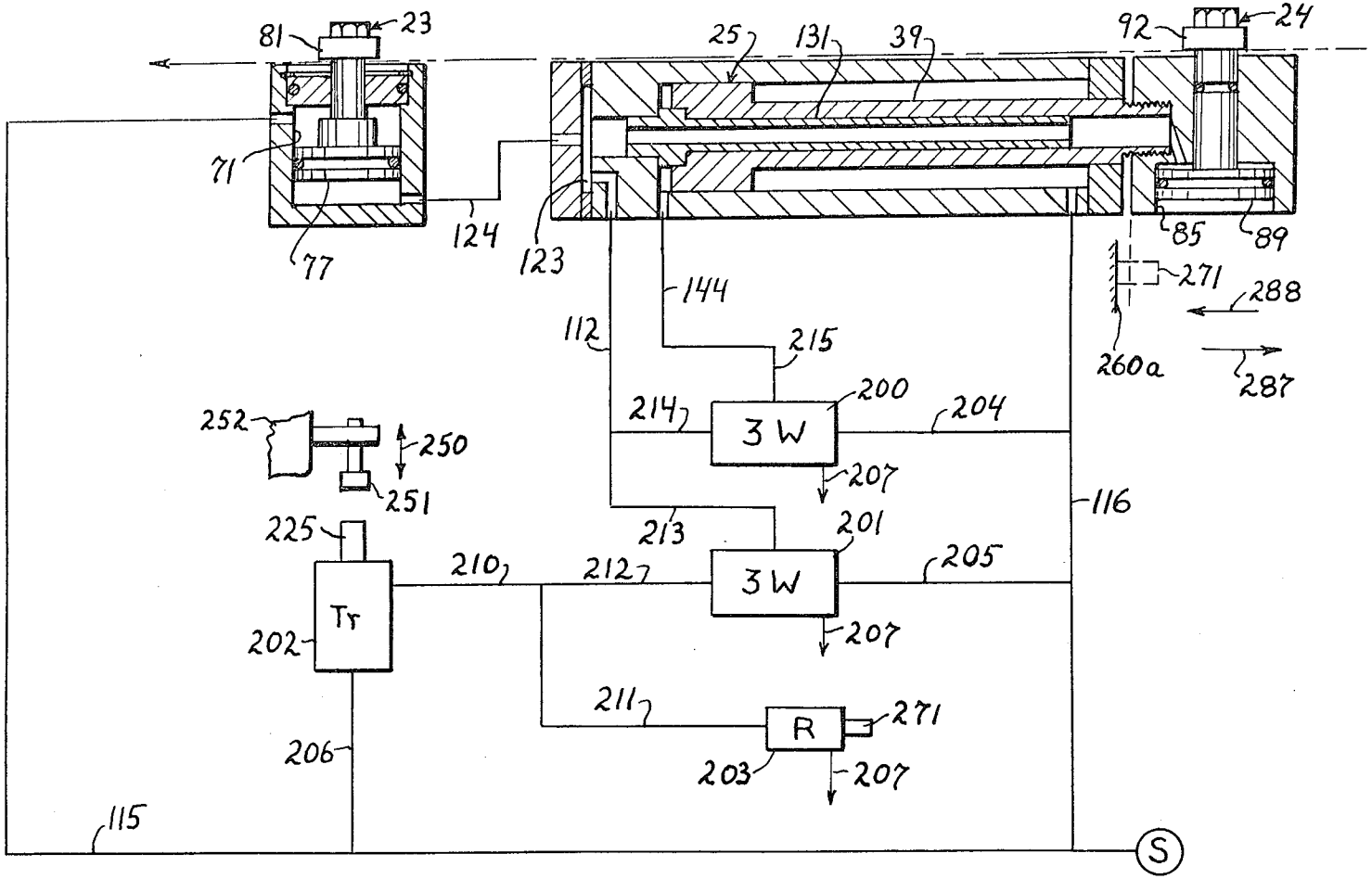
FIG. 1 is a circuit diagram illustrating the semi-automatic control system of the present invention.

The pneumatic control system of the present invention may be used in connection with any suitable structural feeder environment and for illustrative purposes the mechanical arrangement for the feeder disclosed in U.S. Pat. No. 3,038,645 will be used and is encorporated herein by reference. The structural portion of FIG. 1 herein corresponds to that of FIG. 2 of said patent and includes a feed slide 43 that is adapted to be reciprocated in feed and index directions by means of a main fluid motor 25. A stock grip means 24 carried by the feed slide is adapted to be actuated between stock gripping and stock release positions by means of a single acting fluid motor means 85, 89 etc., while a stationary stock clamp means 23 carried by the feeder frame is adapted to be actuated between stock clamping and stock release positions by means of double-acting fluid motor means 71, 77 etc. The rod ends of the stock clamp motor means 71, 77 etc. and the main fluid motor 25 are adapted to be continuously supplied with pressure fluid from a source S through lines 115 and 116 respectively, while lower or head end of said stock clamp motor means 71, 77 etc. and the rod end of stock gripping fluid motor means 85, 89 etc. are interconnected by a line 124 and a passage through the main piston rod 39 and are pneumatically serviced through a chamber 123 and a control line 112. The left or head end of the main fluid motor 25 is serviced through a control line 144. The reference numerals used above correspond to those used in said patent.

The present invention contemplates providing the above described conventional type structural portion of a pneumatic feeder with a novel semi-automatic pneumatic control system which comprises a pair of piloted main valves 200 and 201, a trigger valve unit 202, and a reversing valve 203; the two main valves 200 and 201 and the trigger valve unit 202 being adapted to be continuously supplied with pressure fluid from source S through lines 204, 205 and 206 respectively. Exhaust lines for valves 200, 201 and 203 are indicated at 207. These control system elements are interconnected as follows in order to form an improved semi-automatic control circuit. The pulse output line 210 of the trigger valve unit 202 is connected to the reversing valve 203 and to the pilot connection for the main valve 201 through lines 211 and 212 respectively. The output line 213 of the valve 201 is connected to said stock grip and clamp control line 112 and to the pilot control line 214 for the main valve 200. The output line 215 from the main valve 200 is connected to the said main cylinder control line 144. The main valves 200 and 201 are normally open and normally closed three-way valves respectively and may comprise any suitable piloted three-way valves that are commercially available from such sources as the Clippard Mfg. Co. of Cincinnati, Ohio, the Humphrey Products Division of the General Gas Light Co. of Kalamazoo, Mich., etc.

Figure 2:
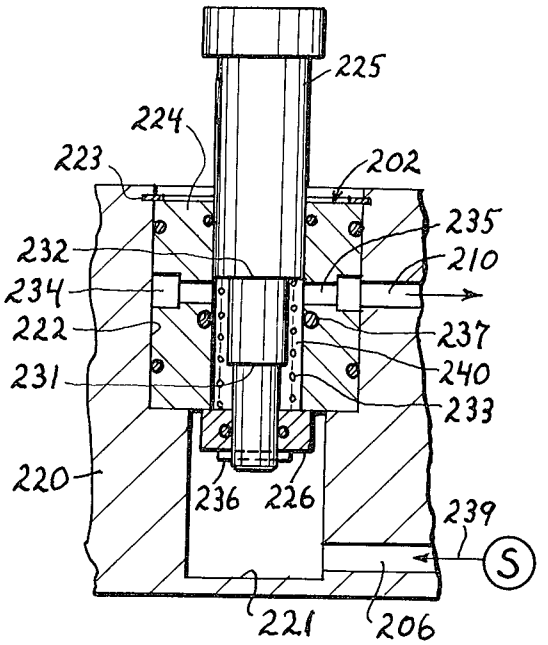
FIG. 2 is a partial axial sectional view illustrating the construction of the instant trigger means.
Figure 3:
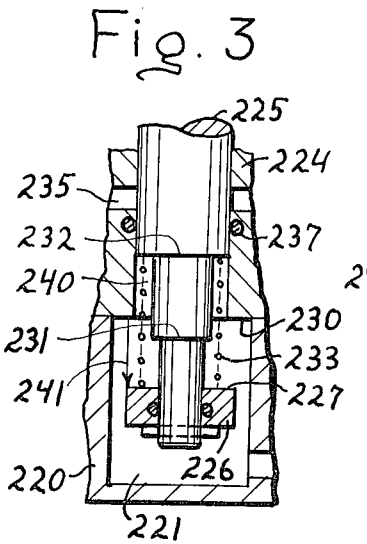
FIG. 3 is an active view illustrating the operation of the apparatus of FIG. 2.

The construction and operation of the trigger valve unit 202 and the reversing valve 203 will now be described in connection with FIGS. 2, 3 and 4–6 respectively. The trigger valve unit of FIGS. 2 and 3 comprises a valve body 220 that is formed with a lower cylindrical chamber 221 which communicates with said supply line 206 and a slightly larger coaxial cylindrical chamber 222. Secured in chamber 222 by means of a suitable internal fastener ring 223 is a tubular collar 224 that coaxially movably supports a valve plunger 225. Disposed in the lower chamber 221 and axially movably supported on the lower end of plunger 225 is a valve disc 226 whose upper outer radial face portion 227, FIG. 3, is adapted as illustrated in FIG. 2, to valvingly cooperate with and seat on the lower inner radial face portion 230, FIG. 3, of the collar 224. The lower end of the plunger 225 is step reduced in size so as to be formed with first and second radial shoulders 231 and 232 respectively, a compression spring 233 being disposed between the shoulder 232 and the valve disc 226. The tubular collar 224 is formed with a peripheral annular groove 234 which communicates with a diametral hole 235 formed through the walls of the collar and with the pulse output line 210 formed in the body 220 of the trigger valve unit. Suitable conventional type O-ring seals such as 237 are provided where needed as indicated in FIG. 2. Pressure fluid, such as air, is continuously supplied as indicated by arrow 239, FIG. 2, through said line 206 to the lower chamber 221 whereby the valve disc 226 and the plunger 225 are yieldably biased upwardly to their normal positions shown in FIG. 2; the upper limit of movement of the plunger 225 being determined by the engagement of a diametral pin 236, FIG. 2, secured to the lower end of the plunger with the lower face of the valve disc 226. In this normal condition of the trigger unit 202 pressure fluid in chamber 221 will be blocked from flowing into the annular space 240 (between the plunger 225 and the inner walls of the tubular collar 224), the line 235, the peripheral groove 234, and the pulse output line 210. The plunger 225 is adapted to be axially moved from its normal FIG. 2 position to a lower or depressed position and then back to its said normal position under the control of the reciprocating movement 250, FIG. 1, of a striker 251 that is carried by the vertically reciprocating ram 252 of the punch press with which the present feeder is to be used; the construction and operation the striker 251 being well understood in the art and illustrated at 17 of FIG. 1 in the above cited patent. During the downward movement of the plunger 225 no pressure pulse is produced in the trigger output line 210 however during the upward movement thereof a pressure pulse will be produced during the last portion of the upward travel of the plunger as will now be explained in more detail.

It should be noted initially that the combination of the plunger shoulder 232 and the O-ring 237 cooperating therewith effectively constitutes an upper normally open two-way spool type valve, while the said cooperating face portions 227 and 230 of the valve disc 226 and collar 224 effectively constitute a lower normally closed two-way poppet type valve; these two two-way valves being mutually coupled in series between the chamber 221 and the said trigger output line 210. When the plunger is operatively moved downwardly under the action of striker 251 the spring 233 will be axially compressed because the valve disc 226 will remain in its said normal FIG. 2 position due to the said upward biasing action of the constant fluid pressure in chamber 221; which biasing action is effectively stronger than that of spring 233. During this downward plunger movement relative to disc 226 the plunger shoulder 232 will valvingly engage the O-ring 237 thus effectively closing the said upper two-way valve. Shortly thereafter the continued plunger motion will cause shoulder 231 to engage the upper face of valve disc 226 and axially displace the latter downwardly so as to effectively open the said lower two-way valve, whereupon the compressed spring 233 can and will axially displace the valve disc 226 to its lower position relative to the plunger as indicated by arrow 241 of FIG. 3; this spring action movement of valve disc 226 now being possible because of the equalized fluid pressure on both sides of the disc 226. As will be seen then during the downward movement of the plunger no pressure pulse is generated in the said trigger output line 210. When the fluid pressure in chamber 221 causes the valve disc 226 and plunger 225 to move upwardly so as to follow the upward movement of said press ram and striker the shoulder 232, when the plunger has nearly reached its upper home position, will move out of sealing engagement with said O-ring 237 so that for the short remaining upward travel of the plunger both the lower and upper two-way valves will be in their open conditions so that pressure fluid may now flow from chamber 221 out through the trigger output line 210. When the plunger reaches its normal upper position the lower two-way valve will again be closed as indicated in FIG. 2. As may be seen then an output fluid pressure pulse is generated only during the terminal portion of the upward travel of plunger 225.

Figure 4:
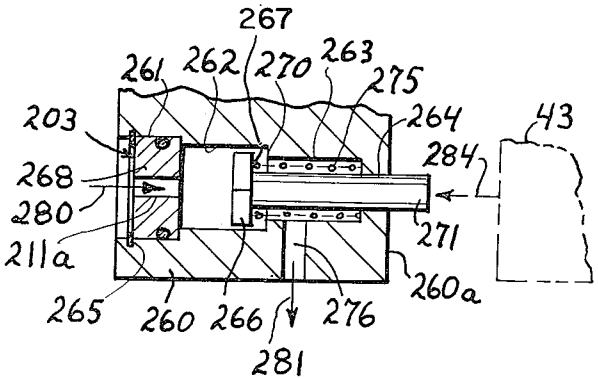
FIG. 4 is a partial axial sectional view illustrating the construction of the reversing valve means.
Figure 5:
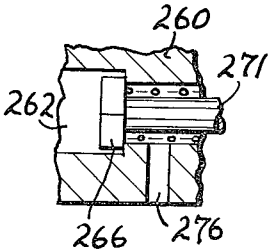
FIG. 5 is an active view illustrating the operation of the apparatus of FIG. 4.
Figure 6:
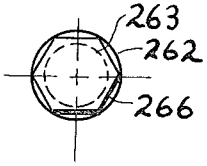
FIG. 6 is a diagrammatic type sketch as viewed from the left in FIG. 5 and illustrates the relative shapes and orientation of the cylinder and internal disc of the reversing valve.

The construction and operation of the reversing valve 203 will now be explained in connection with FIGS. 4–6. Here the valve body 260 is provided with four coaxial bores 261, 262, 263 and 264. Secured in bore 261 by means of any suitable internal fastener ring 265 is a plug 268 having an axial passage **211*a* formed therethrough which is connected to the said line 211, FIG. 1. Disposed in bore 262 is a hexagonal valve disc 266 having a radially outer annular face portion 267 that is adapted to valvingly cooperate with the radial body shoulder 270 formed at the right hand end of bore 262 as seen in FIG. 4. A valve stem 271 is integrally and coaxially connected to the disc 266 and coaxially extends through bores 263 and 264 and projects slightly beyond the end surface 260*a* of the valve body 260. As is diagrammatically illustrated in FIGS. 1 and 4 the valve body 260 and the outer end of valve stem 271 are positioned so that the said stem end is capable of being engaged and axially displaced a short distance to the left from its closed FIG. 5 position to an open position such as is illustrated in FIG. 4. A compression spring 275 is coaxially disposed in bore 263 and operatively extends between the right end of the bore 263 and the valve disc 266 so as to lightly bias said disc to a normal open position illustrated in FIG. 4. The valve body 260 is formed with a suitable exhaust aperture 276 that communicates with the bore 263. When small quantities of air flow into the bore 262, as indicated by arrow 280, FIG. 4, due for example to the presence of small random leaks as might occur in the associated portions of the present control circuit, such air or pressure fluid flow will simply exhaust through the normal open (FIG. 4) two-way valve that is effectively defined by the said valving surfaces 267 and 270 and out through the exhaust line 276 as indicated by arrow 281 of FIG. 4. When however a substantial pressure pulse is received in bore 262, as when the trigger valve unit 203 is operated, the valve disc 226 will be immediately displaced against the relatively light biasing action of spring 275 to its closed FIG. 5 position so as to prevent flow of pressure fluid to the exhaust line 276; this action occurring because of the limited clearance area between the periphery of the valve disc 266 and the adjacent walls of the bore 262. When the valve stem is subsequently moved to the left, as is diagramatically illustrated by arrow 284 of FIG. 4, in response to terminal portion of the feed stroke of the feed slide 43 the valve disc 266 will again be moved to and remain in an open position such as is illustrated in FIG. 4**.

A more detailed description of the operation of the semi-automatic circuit of FIG. 1 will now be made. The normal operative condition for control system is as follows: the output line 210 of the trigger valve unit 202 and the pilot line 212 for the main valve 201 will have been exhausted through line 211 and the reversing valve 203 so that the output line 213 of the normally closed three-way valve 201 will exhaust pressure fluid from the line 112 so as to cause positionment of the clamp bar 81 in a stock clamping condition and the grip bar 92 in a stock release condition. The exhausted lines 112 and 213 will also exhaust pilot line 214 so that the normally open main valve 200 will conduct pressure fluid through its output line 215 to the head end of the main fluid motor 25 so as to displace said feed slide 43 in an index direction, indicated by arrow 287 of FIG. 1, to a normal indexed position determined by the setting of the feeder stroke adjusting screw corresponding to item 58 of said U.S. Pat. No. 3,038,645. Thus in the normal condition of the feeder the stock is clamped by the bar 81 and the feed slide 43 is in an index position ready to execute a feed stroke in the feed direction indicated by arrow 288 of FIG. 1.

When the plunger 225 executes its above described downward and upward movement as controlled by the cyclic movement of the press ram a pressure pulse will be generated as above described in the trigger output line 210 during the terminal portion of each upward plunger movement. This pressure pulse will cause said reversing valve 203 to close as above described and will pilot shift the main valve 201 to an open condition whereupon the resultant pressure fluid in output line 213 will cause clamp bar 81 to shift to a stock release condition and the grip bar 92 to shift to a stock gripping condition. Pressure fluid in line 213 will also pilot shift the main valve 200 to a closed condition so that its output line 215 is exhausted whereupon the fluid motor 25 will displace feed slide 43 through a stock feed stroke in the feed direction 288. The terminal portion of this feed stroke will cause said reversing valve 203 to be opened as above described so as to exhaust lines 211, 210 and 212 thus allowing valve 201 to be shifted back to its normally closed condition which in turn will cause said clamp bar 81 to be shifted to a stock clamp condition and bar 92 to be shifted to a stock release condition, and valve 200 to be pilot shifted to its normally open condition so that the feed slide 43 will now automatically move through a return an index stroke in direction 287 back to said indexed position where it will remain until plunger 225 is again moved through a downward and upward cycle of movement under the control of the next operative cycle of the press. As may be seen then the present control circuit affords a semi-automatic control system which constitutes an improvement over that illustrated in said copending application in that (a) the cascade coupling between the two main valves 200 and 201 insure proper sequencing of the stock gripping and the subsequent movement of the slide 43, (b) the trigger valve unit constitutes a simplified single structural unit, and (c) the normally exhausting reversing valve 203 includes a safety feature which will accommodate small random air leaks as are often present in pneumatic circuits and prevent a pressure build up in the control lines 210, 211 and 212 such as might otherwise reach a pressure level sufficient to inadvertently trigger the initiation of an undesired feed-index cycle of movement of the feed slide 43.

Figure 7:
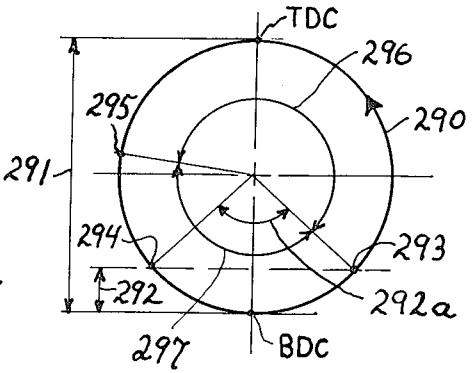
FIG. 7 is a timing diagram illustrating the timing of a typical feed-index cycle of movement of the feed slide in relation to the cyclic timing of a punch press with which the present feeder is associated.

The sketch of FIG. 7 illustrates the timing interfacing of the instant feeder with the operation of the associated punch press. Circle 290 illustrates the continuous counter-clockwise rotation of the press crank shaft which imparts a vertical reciprocating stroke 291 to the press ram as said crank shaft moves through top and bottom dead center TDC and BDC respectively. During the lower portion 292 of the ram stroke 291 and the corresponding angle 292*a* of the press crank movement the press tooling, such as the punch, is in the stock, thus leaving the stock free to be advanced during the remaining stroke portion corresponding to the period that the crank shaft moves from point 293 to 294. The striker 251 is vertically adjusted so that the feeder control plunger 225 initiates a pressure pulse at or shortly after a time corresponding to point 293 which in turn will initiate a stock feed stroke that will be completed for example at point 295. The present semi-automatic feeder control action will then cause the feed slide to move through an index stroke as above described so that the feed slide returns to and remains in its normal indexed position preparatory for the initiation of the next feed stroke which will occur at or shortly after the time point 293. Thus in this example stock feeding occurs during the press crank shaft angle 296 while the return indexing of the feed slide occurs during the crank shaft angle 297.

I claim:

1. A pneumatic feeder for intermittently advancing stock into the work station of a punch press or the like; comprising a frame;

a feed slide reciprocally mounted on said frame;

stock gripping means mounted said feed slide;

main fluid motor means for actuating said feed slide;

stock gripping fluid motor means for actuating said stock gripping means;

main valve means for controlling the operation of said fluid motor means;

trigger means operative to control said valve means so as to cause initiation of a feed stroke of said feed slide; and reverse means operative in response to the terminal portion of said feed stroke for controlling said valve means so as to cause initiation of an index stroke of said feed slide;

said main valve means comprising a first three-way valve that is adapted to be controlled by said trigger means and having an output line that is connected as to operate said stock gripping fluid motor means; and a second three-way valve that is adapted to be controlled by said output line from said first three-way valve and having an output line that is connected so as to operate said main fluid motor means for actuating said feed slide.

2. Apparatus as defined by claim 1 wherein said first three-way valve is a normally closed valve, and wherein said second three-way valve is a normally open valve.

3. Apparatus as defined by claim 1 wherein said trigger means includes a valve means for supplying a control pressure fluid flow to said first three way valve so that the said main valve means thereby causes said feed slide to execute a stock feed stroke.

4. Apparatus as defined by claim 1 wherein said reverse means includes a valve means for controlling said first three way valve so that said main valve means thereby causes said feed slide to execute an index stroke.

5. Apparatus as defined by claim 1 wherein said first and second three way valves are each fluid actuated, and said first fluid actuated three way valve controls the operation of said second fluid actuated three way valve.

6. Apparatus as defined by claim 3 or 4 wherein said trigger means is adapted to supply a momentary flow of control pressure fluid to said first three way valve so that said main valve means causes said feed slide to execute a feed stroke, and wherein said reverse means is adapted to exhaust said control pressure fluid so that said main valve means causes said feed slide to execute an index stroke.

7. Apparatus as defined by claim 5 wherein the output line of said trigger means is coupled to the control line of said first fluid actuated three way valve, wherein said trigger means is adapted to supply a pulse of control pressure fluid to the control line of said first fluid actuated three way valve so that said main valve means causes said feed slide to execute a feed stroke, and wherein said reverse means is adapted to exhaust said control pressure fluid so as to cause said feed slide to execute an index stroke.

8. A pneumatic feeder for intermittently advancing stock into the work station of a punch press or the like: comprising a frame;

a feed slide reciprocally mounted on said frame for operative feed and index strokes;

stock gripping means mounted said feed slide;

main fluid motor means for actuating said feed slide;

stock gripping fluid motor means for actuating said stock gripping means;

a first valve means shiftable to first and second operative conditions, and having an output line that is connected so as to operate said stock gripping fluid motor means;

a second valve means adapted to be controlled by said output line from said first valve means and having an output line that is connected so as to operate said main fluid motor means for actuating said feed slide;

trigger means operative to cause said first valve means to be shifted to its said first operative condition whereby said feed slide may execute a first operative stroke thereof; and reverse means adapted to be operated in response to the completion of said feed stroke of said feed slide to cause said first valve means to be shifted to its said second operative condition whereby said feed slide may execute its next operative stroke.

9. Apparatus as defined by claim 8 wherein said first valve means includes a fluid actuated valve.

10. Apparatus as defined by claim 9 wherein said trigger means comprises a valving means for supplying a control pulse of pressure fluid that shifts said first valve means to its said first operative condition.

11. Apparatus as defined by claim 10 wherein said reverse means comprises a valving means for exhausting said control pressure fluid supplied to said first valve means by said trigger means whereby said first valve means may be shifted to its said second operative condition.

12. Apparatus as defined by claim 8 wherein said first valve means comprises a normally closed three way valve.

13. Apparatus as defined by claim 8 or 12 wherein said second valve means comprises a normally closed three way valve.

14. Apparatus as defined by claim 8, 10 or 11 wherein said first valve means when in its said first operative condition is adapted to cause said feed slide to execute a stock feed stroke.

* * * * *